US007544905B2

(12) United States Patent
Downer

(10) Patent No.: US 7,544,905 B2
(45) Date of Patent: Jun. 9, 2009

(54) JOYSTICK CONTROLLER WITH PUT-AND-STAY CAPABILITY

(75) Inventor: John Downer, Gwent (GB)

(73) Assignee: Penny & Giles Controls Limited, Crosskeys Gwent (GB)

( * ) Notice: Subject to any disclaimer, the term of this patent is extended or adjusted under 35 U.S.C. 154(b) by 0 days.

(21) Appl. No.: 11/642,311

(22) Filed: Dec. 19, 2006

(65) Prior Publication Data

US 2007/0163861 A1 Jul. 19, 2007

(30) Foreign Application Priority Data

Dec. 22, 2005 (GB) ..... 0526062.5

(51) Int. Cl.
*H01H 19/00* (2006.01)
*H01H 21/00* (2006.01)

(52) U.S. Cl. ..... 200/6 A; 200/6 R

(58) Field of Classification Search ..... 200/6 A
See application file for complete search history.

(56) References Cited

U.S. PATENT DOCUMENTS 2,958,233 A 11/1960 Johnson
3,679,846 A * 7/1972 Dillon et al. ..... 200/6 A
3,779,095 A 12/1973 Audet
4,723,458 A * 2/1988 Blok ..... 74/471 XY
5,176,041 A 1/1993 Meier et al.
6,041,675 A 3/2000 Willomitzer
6,201,196 B1 * 3/2001 Wergen ..... 200/6 A
7,019,238 B2 * 3/2006 Kobayashi ..... 200/310

FOREIGN PATENT DOCUMENTS

DE 19711625 10/1997
DE 19711615 A1 9/1998
EP 0459183 12/1991
GB 2 311 234 A 9/1997

OTHER PUBLICATIONS

EP 06 25 6475; EPO Search Report and Written Opinion; mailed Mar. 27, 2007; 6 pp.

* cited by examiner

*Primary Examiner*—Elvin G Enad
*Assistant Examiner*—Lheiren Mae A Anglo
(74) *Attorney, Agent, or Firm*—Wells St. John, P.S.

(57) ABSTRACT

A joystick controller comprises an operating rod (12) mounted for pivotal movement relative to a housing (14) so as to effect movement of a sensor element for providing an output signal indicative of a degree of pivotal movement of the operating rod (12). The joystick also includes at least one friction pad (20*a*, 20*b*) mounted to the operating rod (12) for providing a fictional resistance to movement of the operating rod (12) relative to the housing (14).

12 Claims, 5 Drawing Sheets

VIEW ON A-A

JOYSTICK CONTROLLER WITH PUT-AND-STAY CAPABILITY

This patent application claims priority from an earlier filed Great Britain Patent Application No. 0526062.5, filed Dec. 22, 2005, for "Joystick Controller with Put-and-Stay Capability", by inventor John Downer.

The present invention relates to a joystick controller.

Joystick controllers are known, that include an operating rod, which is mounted for pivotal movement around a pivot point or pivot axis. Such joysticks may be used for a variety of control applications. For example, movement of the operating rod, may cause control signals to be generated for controlling operation (e.g. movement) of an apparatus. In some such control applications it is desirable to include a put-and-stay feature where the user is able to move the operating rod to a position and to let go such that the operating rod stays in that position. However, known joystick designs incorporating put-and-stay features include some form of detent mechanism so that the user must move the operating rod to a predetermined position, at which position the detent mechanism will hold the operating rod until the user subsequently releases it from that position (usually by exerting additional force on the operating rod to overcome the detent). Detent-type put-and-stay mechanisms are ideal for applications such as gear levers or simple FNR (forward, neutral and reverse) controls, but where the joystick is used to provide a fully variable range of output signals (e.g. for accurate movement control) a problem arises if the position of the detent is not the exact position at which the user wants the operating rod to be left. A further problem with known put-and-stay joysticks is that these may be subject to a loss of integrity due to wear. For example, wear in a detent mechanism may result in some backlash or play developing in the detent position.

It is an object of the present invention to provide a joystick controller that alleviates these problems.

According to the present invention there is provided a joystick controller comprising: an operating rod mounted for pivotal movement relative to a housing so as to effect movement of a sensor element for providing an output signal indicative of a degree of pivotal movement of the operating rod; and at least one friction pad mounted to the operating rod for providing a frictional resistance to movement of the operating rod relative to the housing.

It is an advantage that, when in use, the operating rod of the controller can be moved to any desired position so that when the user releases it the friction pad(s) will hold the operating rod at that position.

Embodiments of the invention may include biasing means for urging the friction pad against a friction surface of the housing. The biasing means may comprise one or more compression spring members for urging the friction pad against the friction surface. The spring members may be mounted between opposing surfaces of a pair of friction pads so as to urge the friction pads apart from one another. An advantage of the biasing is that wear of the friction pad does not reduce the effectiveness of the put-and-stay capability, because the biasing continues to urge the friction pad against the friction surface. Means may be provided to allow the frictional resistance to be changed. For example, the spring members may be replaceable allowing springs of different stiffness to be used, or a plurality of spring locations may be provided so that the number of springs used can be changed.

In one embodiment, the joystick controller comprises two friction pads each friction pad being mounted on opposite sides of the operating rod at substantially the same axial location of the operating rod. It is an advantage that the use of two friction pads allows for equal and opposite frictional forces to provide the put-and-stay capability. This means that the frictional forces do not exert any unbalanced force on the operating rod.

In one embodiment, the joystick controller further comprises a gate member affixed to the housing, the operating rod extending through an opening in the gate member. The friction surface may be a surface formed in the gate member.

In one embodiment, the joystick is configured to permit pivotal movement of the operating rod in a predetermined direction. In other words, the operating rod is configured to pivot about a single pivot axis. Preferably, the friction surface lies in a plane parallel to the direction of movement of the operating rod.

In embodiments of the invention, the joystick controller further comprises a detent for holding the operating rod at a predetermined pivotal position. Preferably, the predetermined pivotal position is a central position. In one embodiment, the joystick controller comprises a slider member mounted for movement up and down the operating rod and biased downwards towards the detent. In one embodiment, the detent comprises a raised or recessed portion of the housing and the slider member has a corresponding shape for engagement with the raised or recessed portion of the detent.

It is an advantage that when the operating rod of the joystick is in the predetermined position, a positive action is required by the operator to overcome the biasing action on the slider member before the operating rod can be moved to a new position, but once in the new position the friction pads hold the operating rod in that position until subsequently moved again by the operator.

In embodiments of the invention, the joystick controller includes a ball-and-socket arrangement for allowing the pivotal movement of the operating rod. In such cases it is important for there to be minimal friction between the ball and the socket surfaces so as to avoid wear between these surfaces. It is therefore an advantage that the present invention provides a frictional put-and-stay capability without affecting the wear between the ball and socket surfaces.

The invention will now be described by way of example, with reference to the following drawings.

Figure 1:
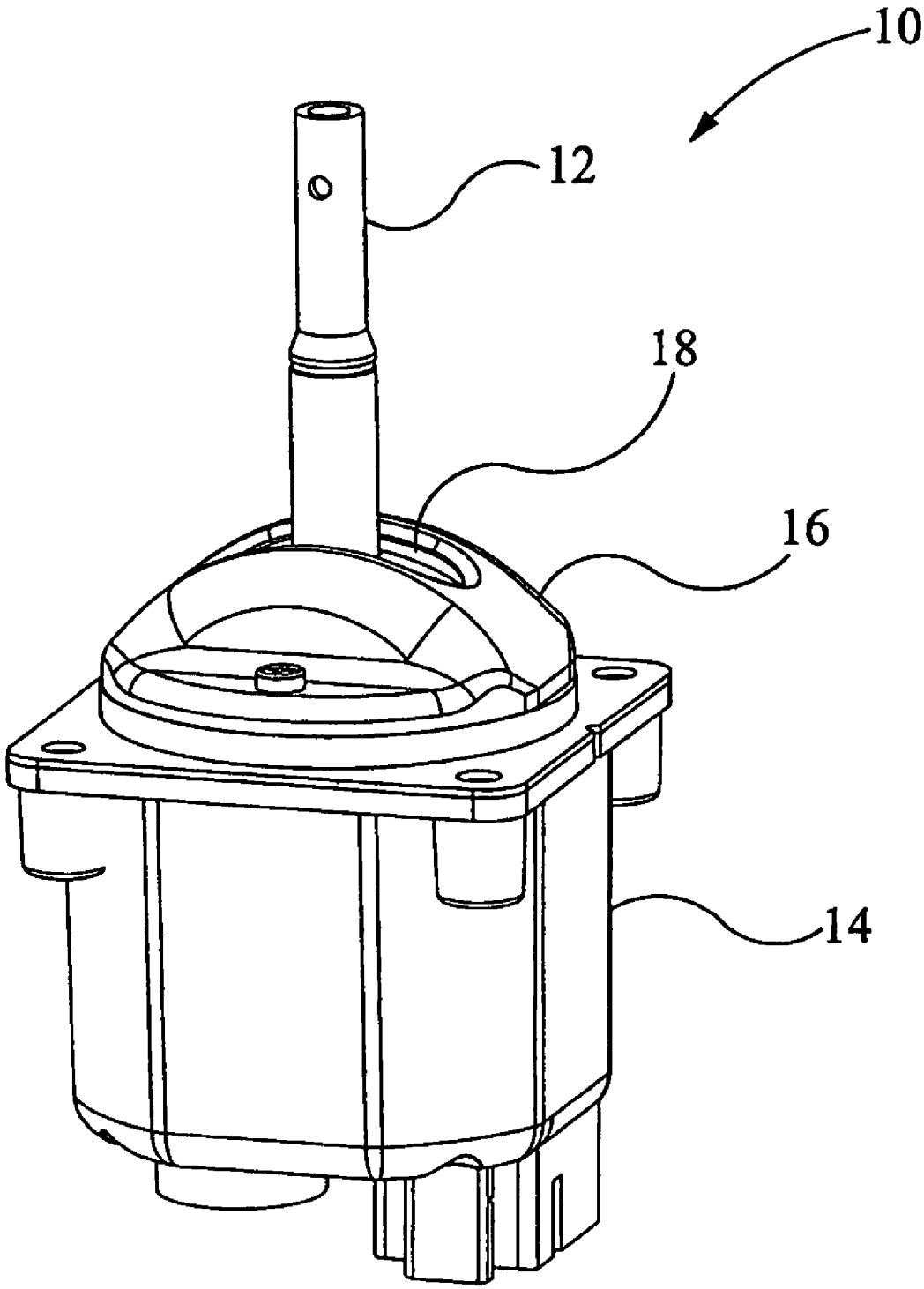
FIG. 1 is a perspective view of a joystick controller according to an embodiment of the invention.

Referring to FIG. 1, a joystick controller 10 includes an operating rod 12, which is mounted for pivotal movement relative to a housing 14. The operating rod 12 protrudes from the housing 14 through a gate opening 18 in a gate member 16 mounted on top of the housing 14. As can be seen, the gate opening 18 is shaped to allow the operating rod to be moved through an arc such that pivotal movement is around a single pivot axis.

Figure 2:
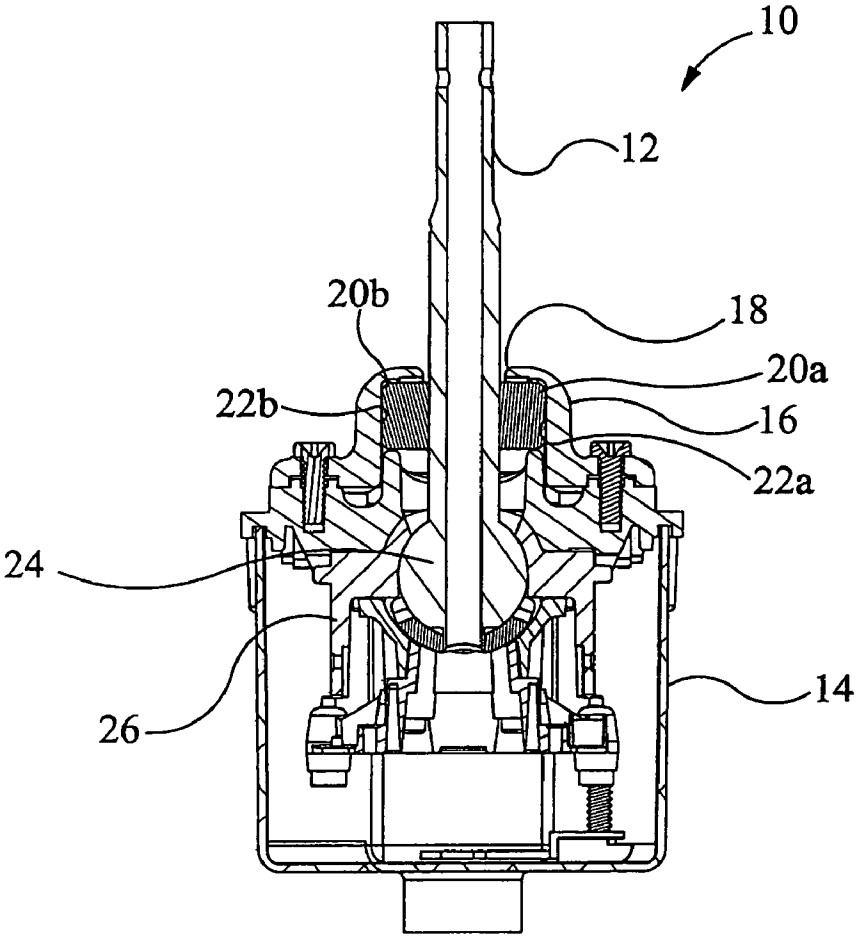

Referring to FIG. 2, where the same components carry the same reference numerals as used in FIG. 1, the operating rod 12 has a ball portion 24 within the housing 14. The ball portion 24 forms part of a ball and socket joint that defines the pivot centre of the pivotal movement of the operating rod 12. Movement of the operating rod 12 (into or out of the page as shown in FIG. 2) causes a yoke member 26 to pivot about the same pivot axis as the operating rod 12. The yoke member 26 carries a moving sensor element forming part of a movement sensor that provides an output signal indicative of the degree of pivotal movement of the operating rod 12.

Mounted, one on either side, on the operating rod 12 is a pair of friction pads 20*a*, 20*b*. The friction pads 20*a*, 20*b* abut against associated friction surfaces 22*a*, 22*b*, which are vertically aligned inwardly facing surfaces formed in the gate member 16. The surfaces of the friction pads 20*a*, 20*b* that abut the friction surfaces 22*a*, 22*b* provide a frictional resistance to movement of the operating rod.

Figure 3:
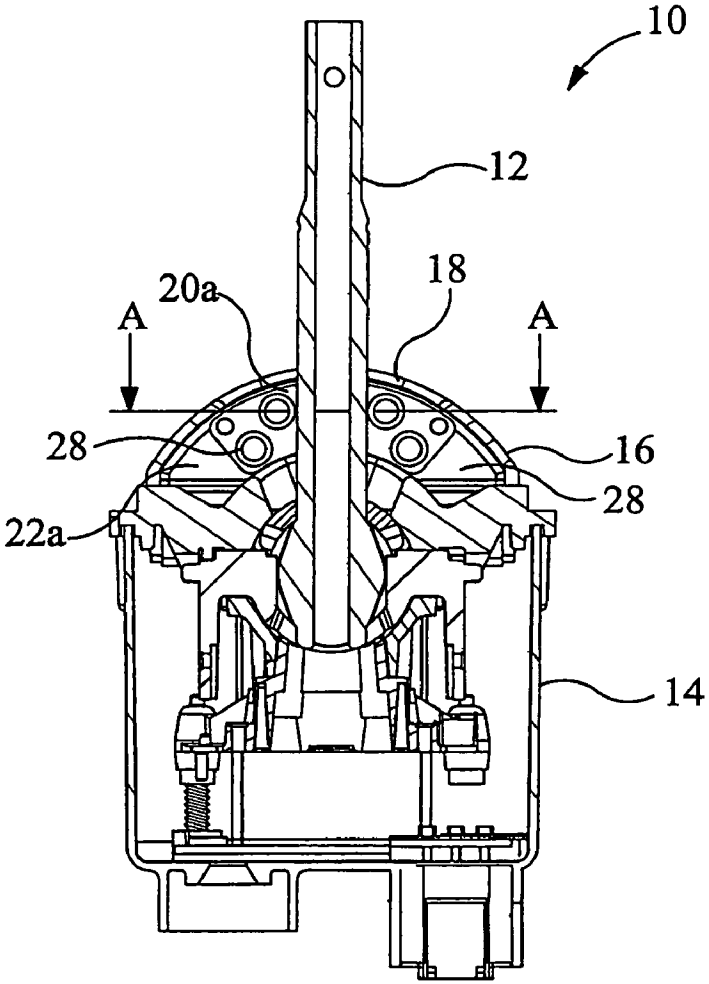
FIGS. 2 and 3 are cross-sections through orthogonal vertical mid-planes of the joystick controller of FIG. 1.

Referring to FIG. 3, where the same components carry the same reference numerals as used in FIGS. 1 and 2, the friction pad 20*a* has an arc shape in the direction of movement of the operating rod 12, and fits within a similarly shaped chamber 28 formed between the gate member 16 and the top of the housing 14. However, the chamber 28 extends around a larger arc angle than the friction pad 20*a*, to allow for movement of the friction pad 20*a* inside the chamber 28, when the operating rod 12 is moved.

The friction pad 20*a* is provided with a set of recessed blind bores 30 that provide locations for helical coil compression springs (not shown). A corresponding set of blind bores is provided in the other friction pad 20*b* (not shown).

Figure 4:
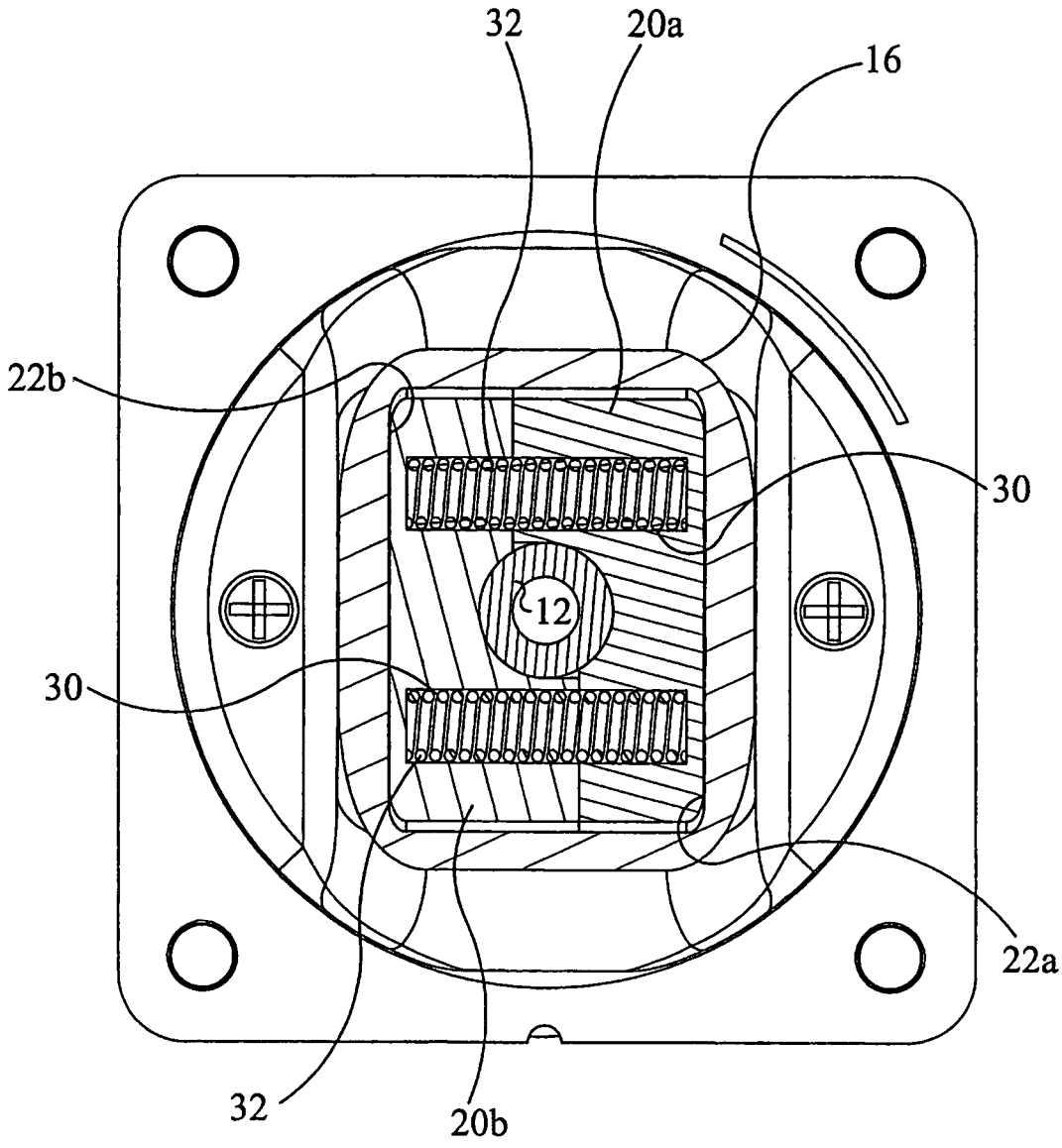
FIG. 4 is a detailed view of a cross-section on the plane A-A of FIG. 3.

Referring to FIG. 4, where the same components carry the same reference numerals as used in FIGS. 1 to 3, the friction pads 20*a*, 20*b* are urged outwardly, away from each other by compression springs 32 mounted between the friction pads 20*a*, 20*b* in the recessed bores 30. The biasing action of the compression springs 32 ensures that the friction pads 20*a*, 20*b* are at all times urged against the friction surfaces 22*a*, 22*b* to provide a consistent frictional resistance to movement, irrespective of the position of the operating rod 12, and even if the friction pads 20*a*, 20*b* have been subjected to wear.

As can be seen in FIG. 4, each friction pad 20*a*, 20*b* extends further towards the other friction pad on one side of the operating rod 12, than on the other side of the operating rod 12. This ensures that, although a small gap may open up between the two friction pads 20*a*, 20*b* due to the biasing action of the springs 32, the operating rod 12 will maintain contact with both friction pads 20*a*, 20*b* in the direction of movement of the operating rod (up and down in the orientation shown in FIG. 4).

In use, an operator can move the operating rod 12 so that it pivots into a new position. In doing so the frictional resistance between the friction pads 20*a*, 20*b* and the friction surfaces 22*a*, 22*b* must be overcome. However, the put-and-stay capability of the joystick means that once the operating rod 12 has been moved to a new position, it can be released. The friction resulting from the friction pads 20*a*, 20*b* being urged by the action of the compression springs 32 against the friction surfaces 22*a*, 22*b* holds the operating rod 12 in the new position until a deliberate attempt is made by the operator to move the operating rod 12 again. This deliberate move must be made with sufficient effort to overcome the frictional resistance.

As can be seen in FIG. 3, provision is made to use up to four compression springs 32 between the friction pads 20*a*, 20*b*. Thus, it is possible to change the frictional resistance by increasing or decreasing the number of compression springs 32 used. Alternatively, compression springs 32 having different stiffness characteristics may be used to change the frictional resistance.

One advantage of the arrangement shown is that the compression springs urge the friction pads 20*a*, 20*b* against the friction surfaces 22*a*, 22*b* to provide an equal and opposite reaction force. This means that there are no out of balance forces exerted against the operating rod 12.

Figure 5:
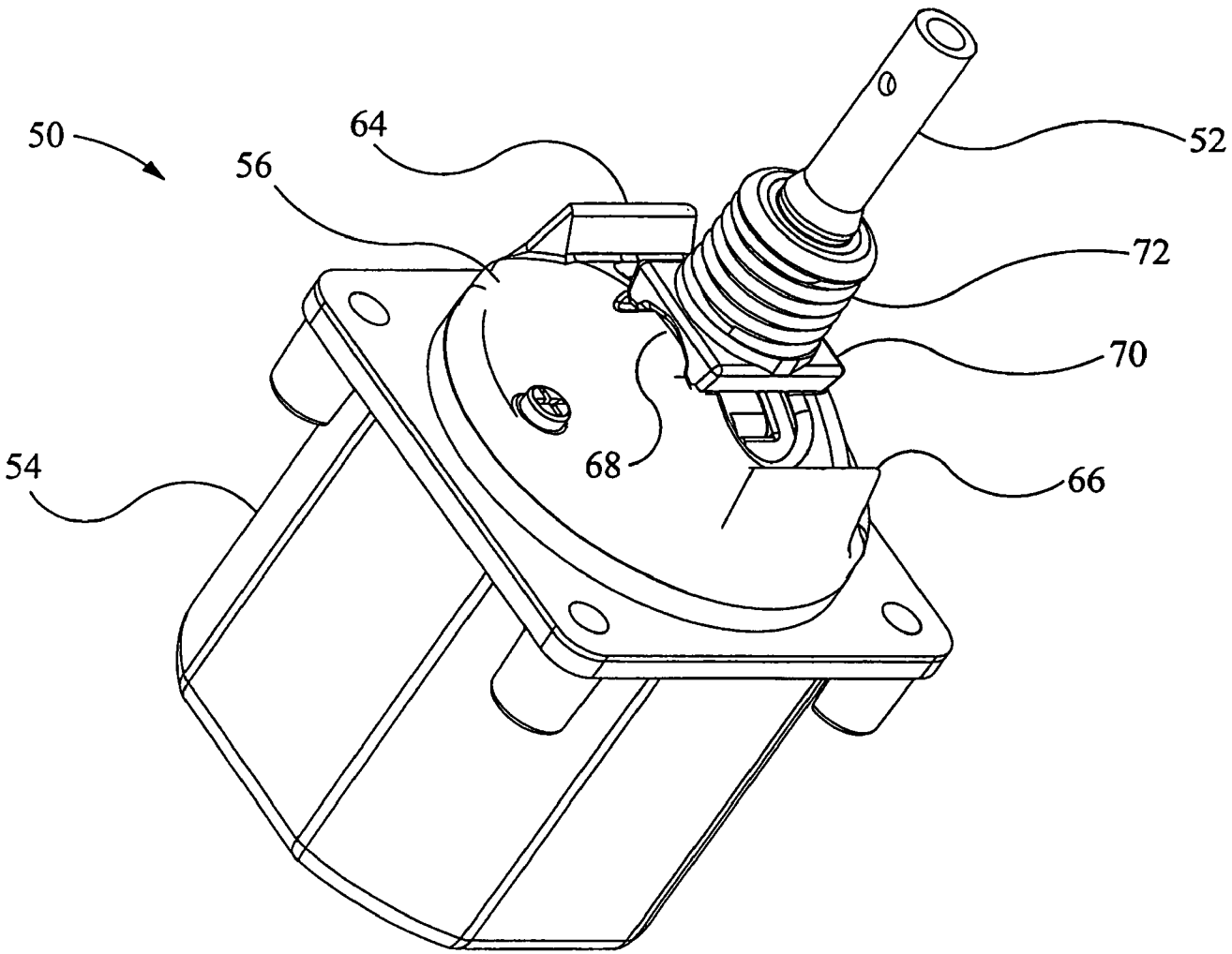
FIG. 5 is a perspective view of a joystick controller according to another embodiment of the invention.
Figure 6:
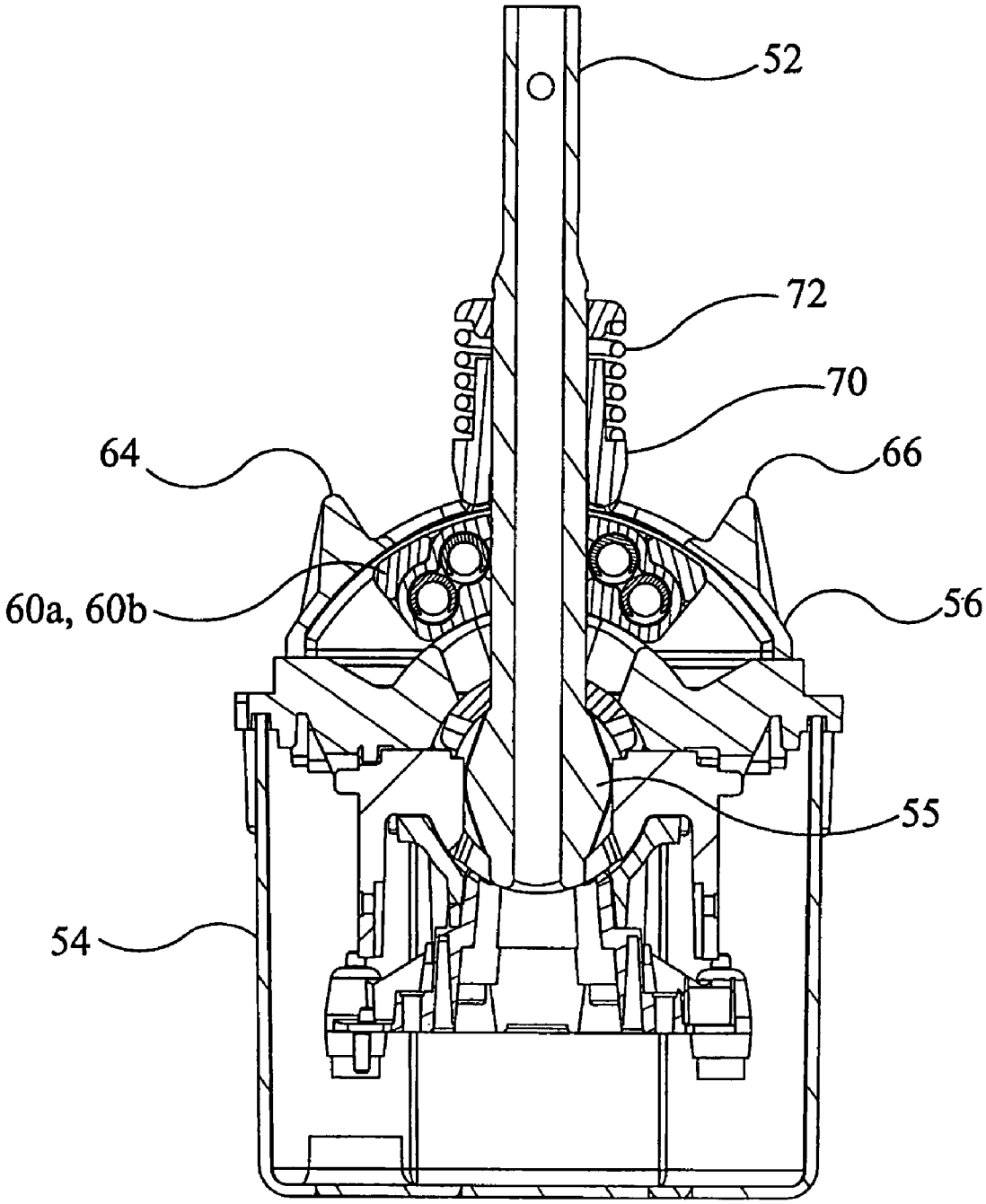
FIG. 6 is a cross-section through a vertical mid-plane of the joystick controller of FIG. 5.

Referring to FIGS. 5 and 6, a joystick controller 50, similar to the joystick controller of FIGS. 1 to 4, includes an operating rod 52, which is mounted for pivotal movement relative to a housing 54 within the confines of a gate opening 58 in a gate member 56 mounted on top of the housing 54. The operating rod 52 is mounted for pivotal movement by means if a ball and socket joint 55 to displace a yoke member 56 in the same manner as described above for the embodiment of FIGS. 1 to 4. A similar arrangement of friction pads 60*a*, 60*b* abutting against associated friction surfaces 62*a*, 62*b* provides the put-and-stay capability as described above for the embodiment of FIGS. 1 to 4.

The joystick controller 50 is also provided with a pair of end-stops 64, 66, protruding upwards from the gate member 56, to define the limits of displacement of the operating rod 52.

As depicted in FIG. 5, the gate member 56 is also provided with a detent 68, forming part of an arrangement for holding the operating rod at a predetermined pivotal position, which in this embodiment is the central position (with the operating rod 52 extending vertically above a horizontal housing 54). The detent arrangement includes a slider member 70 mounted for movement up and down the operating rod 52. A helical spring 72 biases the slider member 70 down the operating rod 52 towards the detent 68. The detent 68 has a raised portion of the gate member 56 housing and the slider member 70 has a corresponding recessed shape for engaging the raised portion of the detent 68.

When the operating rod 52 is in the central position, the slider member 70 is biased downwards into engagement with the detent 68. A positive action is required by the operator to overcome the biasing action on the slider member 70 before the operating rod 52 can be moved to a new position. Once in the new position the friction pads 60*a*, 60*b* hold the operating rod 52 in that position until subsequently moved again by the operator.

The invention claimed is:

1. A joystick controller comprising:

an operating rod mounted for pivotal movement relative to a housing about a pivot centre within the housing so as to effect movement of a sensor element for providing an output signal indicative of a degree of pivotal movement of the operating rod, the operating rod extending through a gate opening in the housing;

at least one friction pad mounted to the operating rod externally of the gate opening for providing a frictional resistance to movement of the operating rod relative to the housing;

biasing means for urging the friction pad against a friction surface of the housing; and wherein the biasing means comprises one or more compression spring members for urging the friction pad against the friction surface.

2. The joystick controller of claim 1 wherein the spring members are mounted between opposing surfaces of a pair of friction pads so as to urge the friction pads apart from one another.

3. The joystick controller of claim 1 comprising two friction pads, each friction pad being mounted on opposite sides of the operating rod at substantially the same axial location of the operating rod.

4. The joystick controller of claim 1 wherein the gate opening is an opening in a gate member affixed to the housing, the operating rod extending through the gate opening in the gate member.

5. The joystick controller of claim 4, comprising a friction surface formed in the gate member.

6. The joystick controller of claim 5 wherein the friction surface lies in a plane parallel to the direction of movement of the operating rod.

7. The joystick controller of claim 1 configured to permit pivotal movement of the operating rod in a predetermined direction.

8. The joystick controller of any claim 1, further comprising a detent for holding the operating rod at a predetermined pivotal position.

9. The joystick controller of claim 8 wherein the predetermined pivotal position is a central position.

10. The joystick controller of claim 8 comprising a slider member mounted for movement up and down the operating rod and biased downwards towards the detent.

11. The joystick controller of claim 10 wherein the detent comprises a raised or recessed portion of the housing and the slider member has a corresponding shape for engagement with the raised or recessed portion of the detent.

12. The joystick controller of claim 1 including a ball-and-socket arrangement for allowing the pivotal movement of the operating rod.

* * * * *